US006352671B1

(12) United States Patent
Daech et al.

(10) Patent No.: US 6,352,671 B1
(45) Date of Patent: Mar. 5, 2002

(54) ALUMINUM ALLOY

(75) Inventors: Alfred F. Daech, Gretna; Nikhil K. Sarkar, New Orleans, both of LA (US)

(73) Assignees: University of New Orleans Foundation, New Orleans; The Board of Supervisors of Louisiana State University and Agricultural and Mechanical College, Baton Rouge, both of LA (US)

( * ) Notice: Subject to any disclaimer, the term of this patent is extended or adjusted under 35 U.S.C. 154(b) by 0 days.

(21) Appl. No.: 09/452,090

(22) Filed: Nov. 20, 1999

Related U.S. Application Data

(60) Provisional application No. 60/110,233, filed on Nov. 30, 1998.

(51) Int. Cl.[7] ..... C22C 21/06

(52) U.S. Cl. ..... 420/547; 420/550; 420/542

(58) Field of Search ..... 420/542, 547, 420/550

(56) References Cited

U.S. PATENT DOCUMENTS

| | | | | | |
|---|---|---|---|---|---|
| 3,619,181 | A | * | 11/1971 | Willey et al. | 75/138 |
| 4,689,090 | A | * | 8/1987 | Sawtell et al. | 148/2 |
| 5,238,646 | A | * | 8/1993 | Tarcy et al. | 420/405 |
| 6,056,835 | A | * | 5/2000 | Miyake et al. | 148/415 |

FOREIGN PATENT DOCUMENTS

| | | | |
|---|---|---|---|
| GB | 295265 | * | 8/1928 |
| JP | 54-56012 | * | 5/1979 |

* cited by examiner

*Primary Examiner*—George Wyszomierski
*Assistant Examiner*—Janelle Combs-Morillo
(74) *Attorney, Agent, or Firm*—Garvey, Smith, Nehrbass & Doody, L.L.C.

(57) ABSTRACT

A corrosion-resistant aluminum alloy includes 91%–95.7% by weight aluminum, 0.5%–1% by weight scandium, 3%–5% by weight magnesium, 0.5%–2% by weight nickel, and 0.3%–1% by weight chromium.

7 Claims, No Drawings

ALUMINUM ALLOY

CROSS-REFERENCE TO RELATED APPLICATIONS

Priority of our U.S. Provisional Patent Application Serial No. 60/110,233, filed Nov. 30, 1998, incorporated herein by reference, is hereby claimed.

STATEMENT REGARDING FEDERALLY SPONSORED RESEARCH OR DEVELOPMENT

The government has rights in this invention, as it was made in performance of work under Office of Naval Research Cooperative Agreement No. N00014-94-2-0011.

REFERENCE TO A "MICROFICHE APPENDIX"

Not applicable

BACKGROUND OF THE INVENTION

1. Field of the Invention

The present invention relates to aluminum alloys. More particularly, the present invention relates to corrosion-resistant aluminum alloys.

2. General Background of the Invention

A good background of the invention can be found in the paper entitled "Feasibility study for development of novel corrosion resistant age hardenable Al—Cr—X alloys for maritime applications" attached to the above-referenced provisional patent application, which paper is incorporated herein by reference.

BRIEF SUMMARY OF THE INVENTION

The apparatus of the present invention solves the problems confronted in the art in a simple and straightforward manner. What is provided are corrosion-resistant aluminum alloys including scandium and magnesium. More information about the present invention can be found in the attached paper entitled "Attachment G—Development of High Strength Corrosion Resistant Al—Sc—X Alloys for Maritime Applications", which paper is incorporated herein by reference.

DETAILED DESCRIPTION OF THE INVENTION

The final report (copy attached) of this study is available from the GCRMTC. Of all the rare earths, Sc has been known to be the most potent strengthener for aluminum alloys. It has been observed in the study that Sc not only strengthens aluminum alloys but also greatly improves their corrosion-resistance. However, its limited supply and high cost restricted its use in the past. This restriction has eased lately because of its availability from Ukraine. As a result, the use of Sc in strengthening aluminum alloys has attracted the attention of manufacturers and researchers in recent times. The available commercial Sc-containing aluminum alloys are modifications of traditional aluminum alloys with a small amount of Sc. The specific composition of the aluminum alloys that is planned to be studied (in particular, the exclusion of corrosion-prone elements) is totally a novel concept. At present no laboratory known is approaching the corrosion problem in aluminum alloys with similar concepts.

Objectives:

The overall objective is to evaluate further selected mechanical, electrochemical (corrosion), and weld properties of a promising high-strength corrosion-resistant alloy system based on the AlMgScCrNi system.

Abstract of Approach: This project requires the direct participation of an aluminum foundry. Proposals will not be considered without this participation.

Task 1: Determination of selected basic mechanical properties such as tensile strength, yield strength, elastic modulus, elongation, work-hardening coefficient, fracture (chevron-notch short bar test) toughness, and impact strength.

Task 2: Evaluation of selected corrosion characteristics including general corrosion, localized corrosion, stress-corrosion and exfoliation.

Task 3: Determination of the weldability of the new alloy system and evaluation of strength and corrosion characteristics of the weldment.

Task 4: Determination of thermomechanical processing parameters (prior deformation, time and temperature of heat treatment) for optimization of strength and corrosion resistance.

Task 5: Modification, if necessary, of the composition of the experimental alloys with other rare earths (Zr, Mo, etc.) to further improve their strength properties and corrosion resistance.

Applicable ASTM or MIL Standards will be followed in carrying out the above tasks. In the absence of such standards, established research methologies will be used to perform a certain number of tasks. They include:

Slow strain rate (SSR) testing and acoustic emission (AE) fracture wave detection for stress corrosion cracking Several electrochemical techniques including impedance-spectroscopy for corrosion evaluation.

Additionally, attempts should be made to obtain information on the microstructure of various alloys as a function of their heat treatment and composition. The techniques to be used for this purpose may include differential scanning colorimetry (DSC), scanning electron microscopy (SEM), and energy-dispersive x-ray analysis (EDXA). Structure dictates properties. Thus, the structural information will be of value in selecting appropriate parameters for alloy composition and heat treatment. The SEM and EDXA should also be utilized to characterize the weldment structure, the corrosion-induced changes in the alloy, and in weldments, as well as to obtain fractographic information from specimens that failed during mechanical and stress-corrosion testing.

In all stages of the proposed research, alloys that are traditional and popular (2024-T3, 5052-T3, 6061-T6, 7072 and 7075-TT6) must be studied for control and comparison.

Schedule:

A contract term of one to two years is envisioned as necessary to complete the project objectives. The proposal may be written as a multi-year project (1, 2 or 3 years), but review and re-approval will be required for each continuation year.

Deliverables:

Further research should allow a "fine-tuning" of the composition and processing parameters of the experimental alloy system and should lead to the development of an alloy system superior to existing alloys in mechanical properties, corrosion resistance, and weldability. The deliverable for this project will be a prototype aluminum alloy that will include documentation of the alloy's chemical composition, mechanical, electrical, thermal, corrosion, etc properties, manufacturing procedures, quality control, and applications.

A provisional U.S. Patent application has been filed on this material through the GCRMTC. The developed alloy specifications will be available to metal producers, users, and other interested parties from the GCRMTC.

A report must be prepared to allow for marketing the project's deliverables throughout the US.

A presentation must be prepared for and delivered to at least two technical societies or trade show meetings after approval by the GCRMTC.

An article describing this work must be written in conjunction with the year end report and submitted for publication to at least one technical or trade journal after approval by the GCRMTC.

Materials for a half day marketing seminar, including audio/video material to be presented at two or more locations with the purpose of promoting the use of this project's deliverables. This program should be given in collaboration with the contractor and the GCRMTC.

Equipment including sensors, computers, etc. used to conduct the project must be delivered to the GCRMTC upon completion of the project unless specific arrangements are made for the continued operation of the equipment in conjunction with GCRMTC and UNO through a similar program.

Software, object and source code, developed for the project must be delivered to the GCRMTC (one copy) with a royalty free license for the State of Louisiana, UNO, and the US Government.

Software purchased for the project must be delivered to the GCRMTC upon completion of the project.

The contractor must present a status report of the project at the University of New Orleans on a semi-annual basis. Additionally, written quarterly and annual status reports and periodic input for the MANTECH Database system, in the format specified by the GCRMTC, will be required.

The apparatus of the present invention can comprise a ship, aircraft, or marine structure made of the alloy of the present invention for use in halide-containing water. The apparatus of the present invention can be used in water containing chloride.

Other embodiments of the present invention are described in the paper entitled "Feasibility study for development of novel corrosion resistant age hardenable Al—Cr—X alloys for maritime applications".

All measurements disclosed herein are at standard temperature and pressure, at sea level on Earth, unless indicated otherwise.

The foregoing embodiments are presented by way of example only; the scope of the present invention is to be limited only by the following claims.

What is claimed is:

1. A corrosion-resistant aluminum alloy consisting essentially of 91%–95.7% by weight aluminum, 0.5%–1% by weight scandium, 3%–5% by weight magnesium, 0.5%–2% by weight nickel, and 0.3%–1% by weight chromium.

2. The alloy of claim 1, containing no appreciable amount of zinc or copper.

3. A method of providing corrosion resistance in an article, comprising making a part of the article which is designed to be in contact with halide-containing water of the alloy of claim 1.

4. The method of claim 3, wherein the water contains chloride.

5. Apparatus made of the alloy of claim 1 for use in halide-containing water.

6. The apparatus of claim 5, wherein the water contains chloride.

7. The apparatus of claim 5, comprising a ship, aircraft, or marine structure.

* * * * *